United States Patent [19]

Lazar et al.

[11] Patent Number: 4,885,444

[45] Date of Patent: Dec. 5, 1989

[54] SWITCHGEAR OPERATING MECHANISM

[75] Inventors: Lawrence W. Lazar, West Allis; Ronald A. Wainio, So. Milwaukee, both of Wisconsin

[73] Assignee: Cooper Industries, Inc., Houston, Tex.

[21] Appl. No.: 186,456

[22] Filed: Apr. 26, 1988

Related U.S. Application Data

[63] Continuation-in-part of Ser. No. 894,643, Aug. 8, 1986, abandoned.

[51] Int. Cl.[4] ..... H01H 3/00

[52] U.S. Cl. ..... 200/401; 200/400; 200/320

[58] Field of Search ..... 200/320, 318, 324, 330, 200/331, 400, 325, 321; 74/2

[56] References Cited

U.S. PATENT DOCUMENTS

| | | | |
|---|---|---|---|
| 1,310,168 | 7/1919 | Sessions | 200/318 |
| 2,389,220 | 11/1945 | Tredeau | 200/331 |
| 4,124,790 | 11/1978 | Kumbera et al. | 200/401 |
| 4,358,646 | 11/1982 | Martinez | 200/330 |
| 4,578,551 | 3/1986 | Lin | 200/400 |
| 4,625,189 | 11/1986 | Lazar et al. | 200/400 |
| 4,762,971 | 8/1988 | Yabe | 74/2 |

FOREIGN PATENT DOCUMENTS

| | | | |
|---|---|---|---|
| 402543 | 7/1966 | Australia | 200/400 |

*Primary Examiner*—Linda J. Sholl

*Attorney, Agent, or Firm*—Haight & Hofeldt

[57] ABSTRACT

A switchgear operating mechanism is disclosed which includes two helical springs which are stretched to store energy to close and then open circuit breaker contacts. A mechanism is provided for stretching the springs in response to reciprocating movement of a hook stick. A single operating handle is provided with a spring biased detent arrangement such that the handle may be moved from a predetermined reset position to a closed position to close the circuit breaker contacts using energy from the charged springs. The handle is returned to the reset position by the spring biased detent arrangement and may be moved from that position to an open position to open the circuit breaker contacts using energy from the charged springs. The handle is preferably operable by a shot gun type hook stick.

21 Claims, 11 Drawing Sheets

FIG. 1
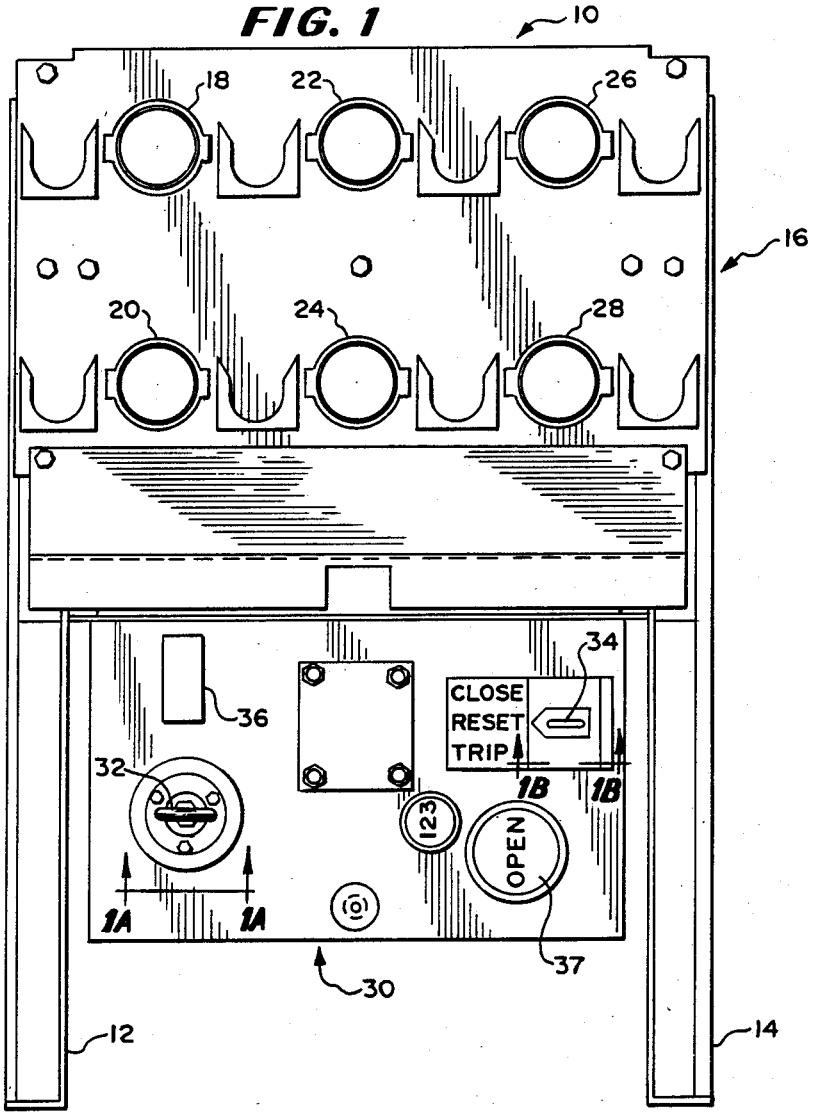
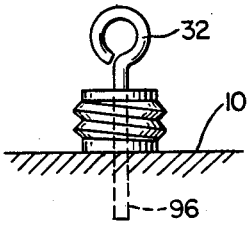
FIG. 1A
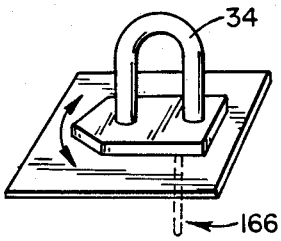
FIG. 1B

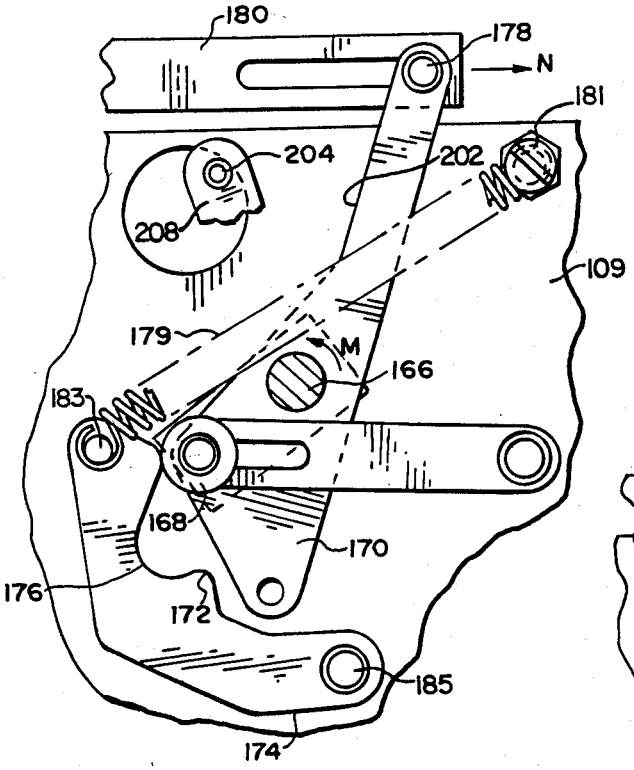
FIG. 12
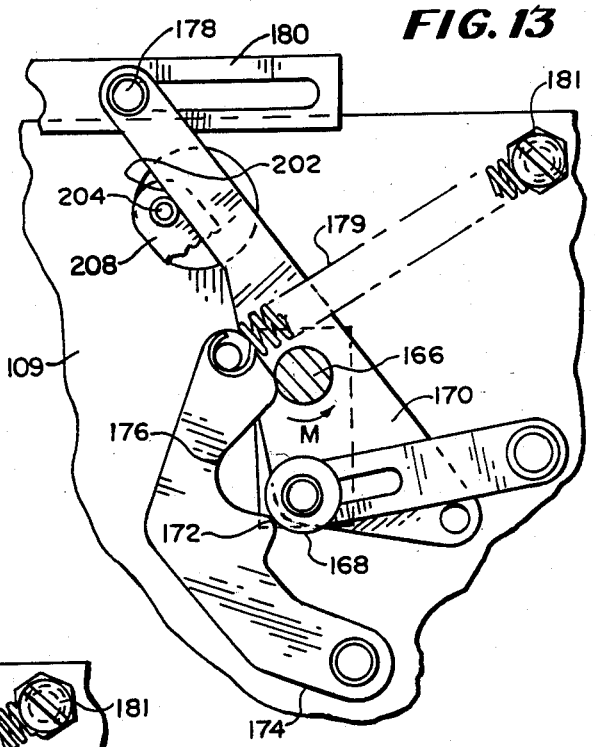
FIG. 13
FIG. 14
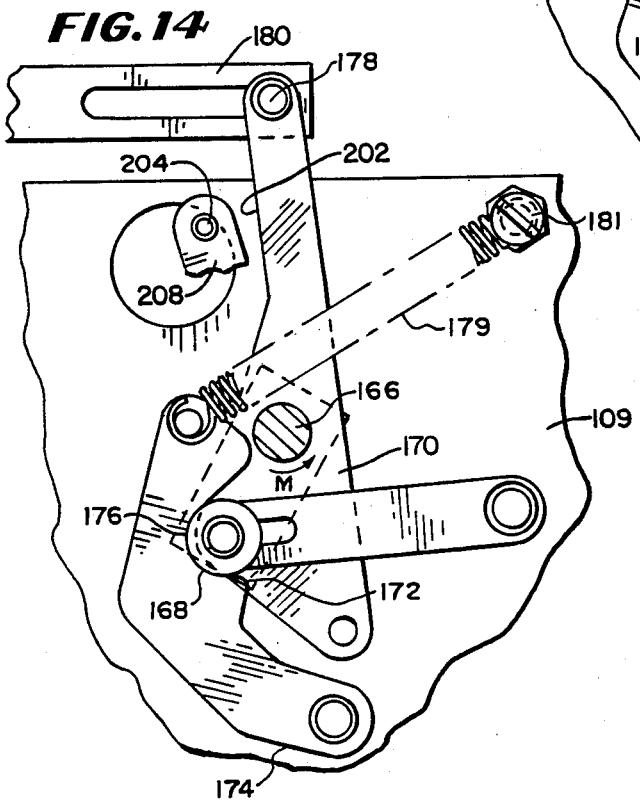

SWITCHGEAR OPERATING MECHANISM

This application is a continuation-in-part (CIP) of U.S. patent application Ser. No. 06/894,643, filed on Aug. 8, 1986, and now abandoned.

TECHNICAL FIELD

This invention relates to a switchgear operating mechanism for use in operating circuit interrupters in power distribution systems. In particular, it relates to a unique mechanism which can be safely operated manually and while at a safe distance from the mechanism.

BACKGROUND OF THE INVENTION

It is desirable to incorporate circuit interrupters in power distribution systems, which circuit interrupters may in some cases be automatically operated in response to abnormal load or line conditions, and in other cases may be manually operated to permit energization and deenergization of a portion of the power system to accommodate maintenance work and other operating requirements. It has been found advantageous in certain applications to utilize vacuum interrupters as the circuit interrupters. Some of the advantages of using vacuum interrupters are their fast, low energy arc interruption with long contact life, low mechanical stress and a high degree of operating safety. A vacuum interrupter is constructed with a pair of contacts sealed in a vacuum enclosure with a movable contact having an operating member extending through a vacuum seal in the enclosure. A spring loaded toggle mechanism is preferably coupled to the operating member for rapidly and positively opening and closing the contacts.

One such operating mechanism is disclosed in U.S. Pat. No. 4,124,790, issued Nov. 7, 1978 to Kumbera and Bordak and assigned to assignee of the present invention. One commercially available operating mechanism is provided with two separate operating levers, one of which controls the trip or open function and the other of which controls the close function of the circuit interrupter. In this particular mechanism it is necessary to manually reset the lever which trips the mechanism after the contacts have been tripped or opened. Typically, a separate manually operated crank handle is provided for charging a stored energy operator. That crank must be rotated a relatively large number of times (i.e., 250 to 350 revolutions), and is not conveniently operated at a remote distance from the mechanism.

It would be desireable to have a switchgear operating mechanism in which the circuit breaker contacts can be both closed and opened by the displacement of a single operating handle, rather than two or more separate handles. It would also be desirable to provide a detent arrangement which will return or maintain the single operating handle in predetermined locations. More importantly, it would be highly desirable to provide a mechanism which, from a remote location using reciprocating motion, could charge an energy storage mechanism for providing energy to close and open the circuit breaker contacts. This is all the more desirable once it is understood that switchgear, particularly high voltage switchgear, is often housed in underground storage vaults or in spaces which are difficult to gain access. From a safety point-of-view, it would be very desirable to operate such mechanism at a safe distance and without having to use complicated or specialized equipment.

SUMMARY OF THE INVENTION

The present invention provided a switchgear operating mechanism which uses a single operating handle to both close and open the contacts of a circuit breaker and which uses reciprocating motion to store mechanical energy to operate the mechanism. First and second resilient yieldable means, such as helical springs, are provided to store energy for use in closing and opening the contacts of the circuit breaker. A rotatable member is connected to one end of the helical springs in such a way that, as it is rotated in a predetermined direction, the helical springs are elongated to store energy therein. The rotatable member includes a first shaft from which a second shaft is supported in a parallel spaced relationship by a pair of arms for rotation with and about the first shaft. One end of the helical springs is connected to the second shaft, such that as the first shaft rotates, the springs are stressed or elongated. The first shaft is rotated to stress the springs by a motor drive, or by a manual charging means which includes a motion translation means which causes rotation of the first shaft in response to reciprocating motion of a charging member formed as a shaft with a manual engageable handle on one end. The motion translation means includes a linkage assembly and a lever connected to the first shaft through a one way clutch. Reciprocating motion, such as that produced by a shot gun type hook stick, of the charging member is translated through the linkage assembly, lever and one way clutch to cause rotation of the first shaft in a direction to stress the helical springs upon movement of the charging member in one direction. The one way clutch permits the charging member to be returned in the opposite direction without rotation of the first shaft. When the first shaft has been rotated a predetermined amount to stress the helical springs, the linkage assembly is rendered ineffective to further rotate the first shaft in response to reciprocation of the charging member. An operating handle, also operable by a hook stick, is provided which may be moved between predetermined positions to release the stored energy in the helical springs to close and open the circuit breaker contacts. A spring and detent arrangement is provided to establish the predetermined positions of the operating handle. The spring and detent arrangement biases the operating handle to a reset position, to which the operating handle is returned after being moved to a predetermined position to close the circuit breaker contacts. The operating handle may then be moved from the reset position to a predetermined position to open the circuit breaker contacts. The helical springs may then be recharged with the operating handle in either predetermined open or reset positions. However, the operating handle must be moved to the rest position before it can be moved to the predetermined position to close the circuit breaker contacts.

The following advantages and features are evident:

1. Less time is required to manually charge the mechanism.

2. The maintenance of the charge or the provision for stored energy can be performed at a distance with industry standard electrical hook sticks which are readily available to utility crews.

3. If a malfunction were to occur in the electric motor charging circuit or operating circuit, the present invention allows the motor to act independently of the manual charging shaft, thereby reducing the risk of injury to personnel who may be operating the device manually.

4. Rectilinear motion of the charging shaft eliminates the need for radial support bearings and rotary shaft seals (Compare U.S. Pat. No. 4,578,551).

5. Unlike the prior art (See Australian Patent 402,543 to Lumachi), where a motor failure resulting from a locked or seized shaft condition would render the switchgear spring charging mechanism inoperative and the device would have to be placed out of service for repair—even if manual operation would be satisfactory for the switchgear's requirements in a coordination scheme, the present invention allows for automatic independent operation of either the manual charging or motor charging means. Thus, in the event of motor failure from a locked or seized shaft condition, full operational capacity is provided for by the present invention, thereby avoiding the need to remove the device from service until a convenient repair schedule can be arranged.

Numerous other advantages and features of the present invention will become readily apparent for the following detailed description of the invention, the embodiment described therein, from the claims, and from the accompanying drawings.

BRIEF DESCRIPTION OF THE DRAWINGS

FIG. 1 is a front elevation view of a switchgear operating mechanism constructed in accordance with the teachings of the present invention;

FIGS. 1A and 1B are cross sectional views of the manual operating handles as seen in FIG. 1;

FIG. 12 is a fragmentary side elevation view of a portion of the mechanism shown in FIGS. 10 and 11, shown with the components in the operating position for closing the circuit breaker contacts;

FIG. 13 shows the mechanism of FIG. 12 in the operating position to open the circuit breaker contacts;

FIG. 14 shows the mechanism of FIGS. 12 and 13 in the reset or discharged positions;

DESCRIPTION OF THE PREFERRED EMBODIMENT

Figure 2:
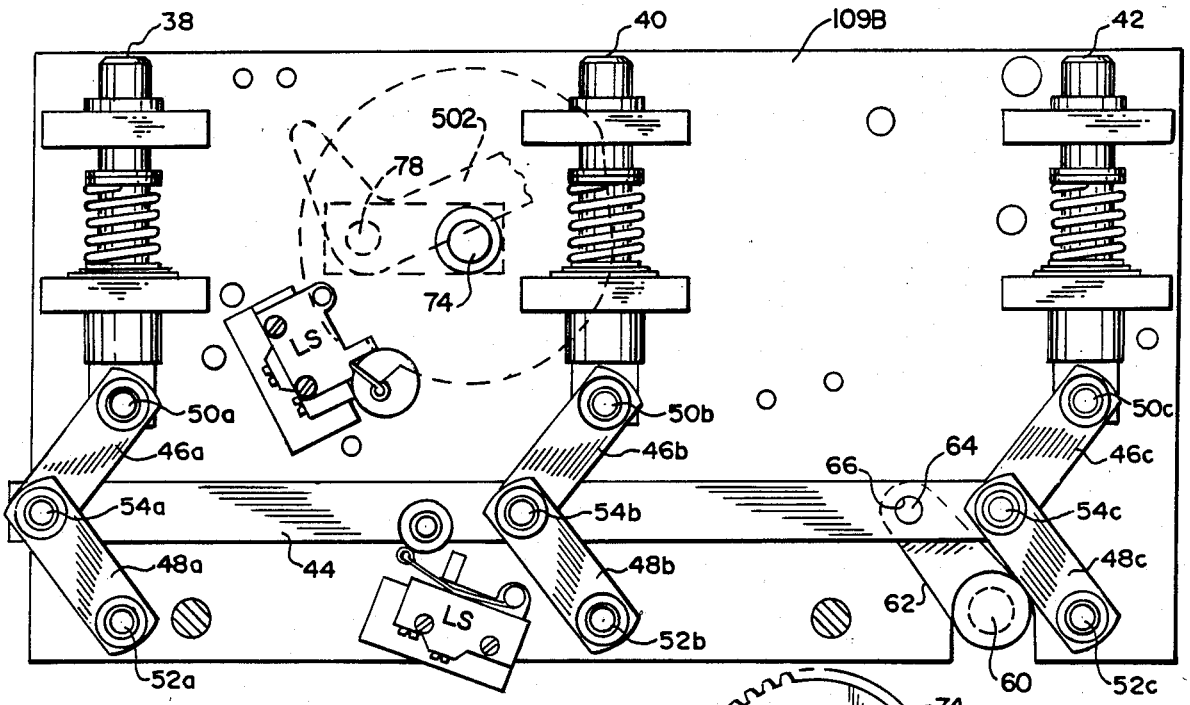
FIG. 2 is a side elevational view of that portion of the switchgear operating mechanism which actuates the circuit breaker contacts.

While this invention is susceptible to embodiment of many different forms, there is shown in the drawings and will herein be described in detail one particular embodiment of the invention. It should be understood, however, that the present disclosure is to be considered an exemplification of the principles of the invention and is not intended to limit the invention to the specific embodiment illustrated.

To aid in understanding the invention, an overview of the operation of the device will first be provided and then specific components will be described in greater detail.

Overview

Referring to FIG. 1, a front elevation view of the improved switchgear mechanism of this invention is shown. The switchgear mechanism is mounted in a cabinet 10 which is supported by a pair of legs 12 and 14. The upper portion 16 of the cabinet encloses the electrical contacts of the switchgear mechanism. The illustrated switchgear mechanism is for three-phase use, with electrical connections being made to three-phases of a power system through pairs of terminals 18 and 20, 22 and 24, and 26 and 28. In the preferred embodiment of the invention, a normally opened vacuum circuit breaker or interrupter is included between each of the pairs of contacts 18 and 20, 22 and 24, and 26 and 28. A vacuum interrupter of the type which might be used with the switchgear mechanism of this invention is illustrated in U.S. Pat. No. 4,124,790, issued Nov. 7, 1978 to Kumber and Bordak.

The lower portion 30 of the housing 10 includes the improved switchgear operating mechanism of this invention, with manual operating handles 32 and 34 shown on the face thereof As will be hereinafter explained, by applying a reciprocating force to one handle 32, two sets of helical operating springs are extended or charged. One set of the springs provides a force to move the interrupter contacts from their open to their closed position and the other set of springs provides a force to move the interrupter contacts to their tripped or open position. Preferably this handle 32 is provided with an eyelet or other means for being operated by hook stick of the type having a remotely operated set of jaws (i.e., shot gun hook stick). A window 36 is provided to indicate whether or not the springs are charged.

Providing the operating springs have been previously charged, movement of the second operating handle 34 (which is shown in the "reset" position) to the position marked "close" will cause the interrupter contacts to close. Movement of this handle 34 in the direction from the "close" though the "reset" to the "trip" position will cause the contacts to open. Upon operation of the mechanism to cause the contacts to either close or to trip (i.e., the open position), a flag, appearing in a window 37, will indicate the position of the contacts. Preferably, the second handle 34 is provided with a means or eye for also being operated by a hook stick. A counter 123 is provided to indicate the number of complete cycles or operations through which the mechanism has operated.

Main Mechanism

The mechanism which moves the interrupter contacts from their open to their closed position is shown in FIG. 2. Operating rods 38, 40, and 42 engage actuating rods (not shown) extending from the vacuum circuit interrupters. As viewed in FIG. 2, the rods 38, 40, and 42 are shown in their retracted (lower) position, which corresponds to the open or tripped position of the interrupter contacts. Movement of the rods 38, 40 and 42 in the upward direction will cause them to push against and move the operating rods of the circuit interrupters, so as to push the interrupter contacts into their closed or engaged position. The rods 38, 40, and 42 are moved to their upward position by movement of a bar 44 to the right, as viewed in FIG. 2. Lever arms 46 *a, b,* and *c* are pivotally secured by pivot pins 50 *a, b,* and *c* to the rods 38, 40, and 42.

Similarly, lever arms 48 *a, b,* and *c* are pivotally secured to the frame of the switch mechanism by pivot pins 52 *a, b,* and *c*. Lever arms 46 *a, b,* and *c* and lever arms 48 *a, b,* and *c*, respectively, are pivotally secured to the bar 44 by pins 54 *a, b,* and *c*. Movement of the bar 44 to the right, as viewed in FIG. 2, will cause pins 54 to move upward and to the right, thereby forcing rods 38, 40, and 42 to move upwardly as lever arms 46 *a, b,* and *c* pivot counter clockwise around pivot points 50 *a, b,* and *c*.

Figure 5:
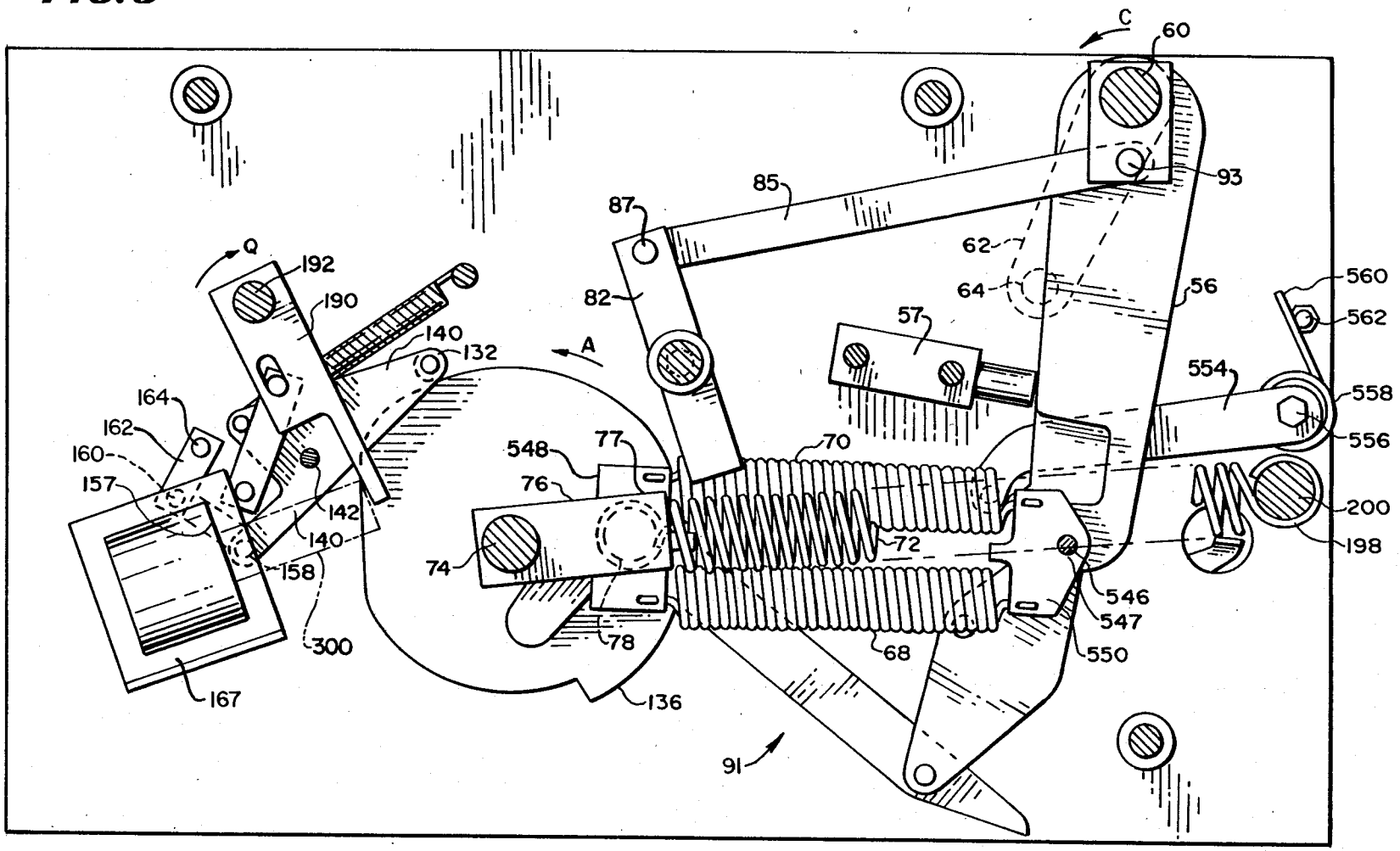
FIG. 5 is a side elevational view of a portion of the switchgear mechanism showing the mechanism after it has opened the circuit interrupter and prior to being reset.
Figure 6:
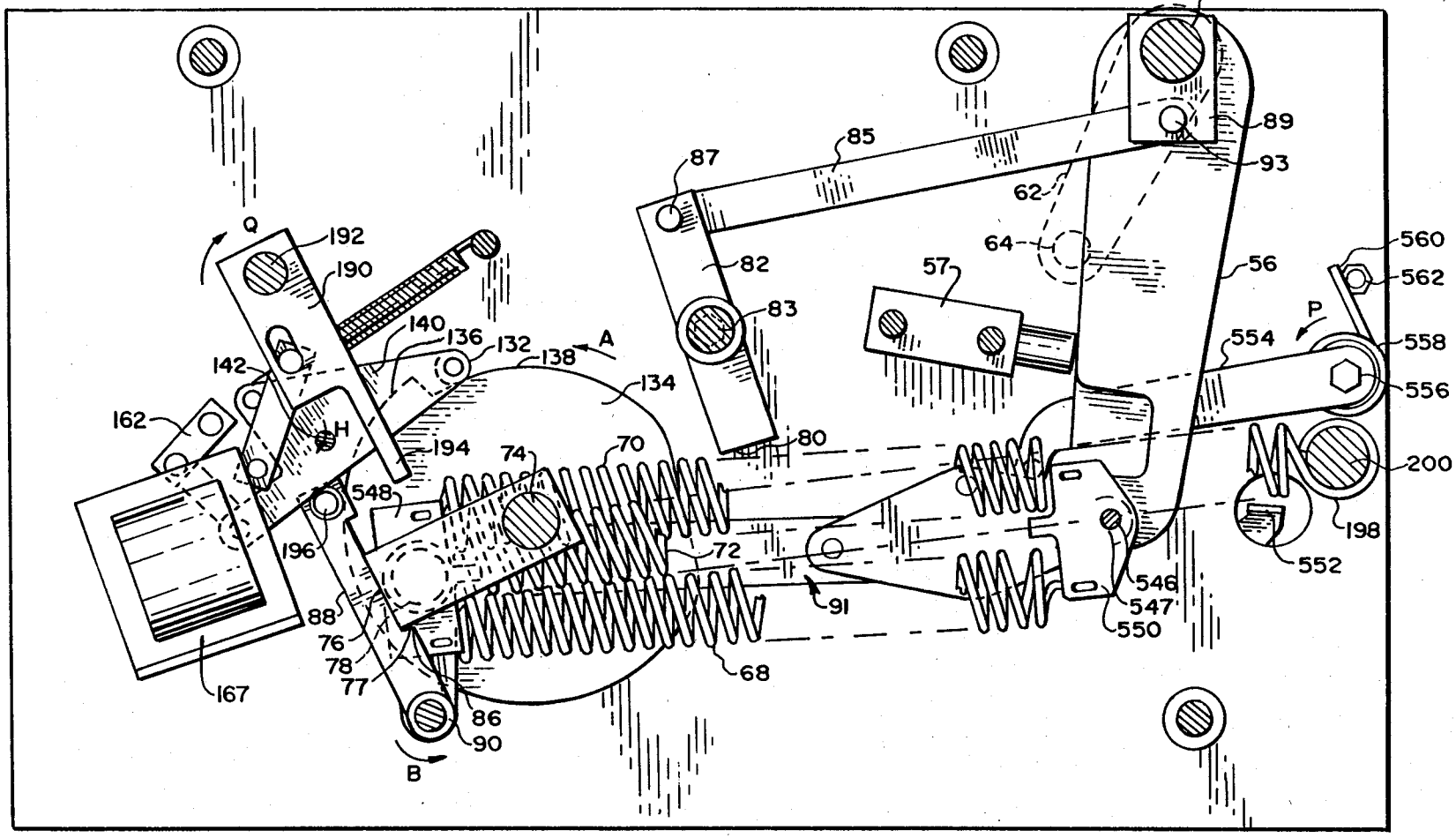
FIG. 6 shows the same mechanism as shown in FIG. 5, but in the reset condition.
Figure 7:
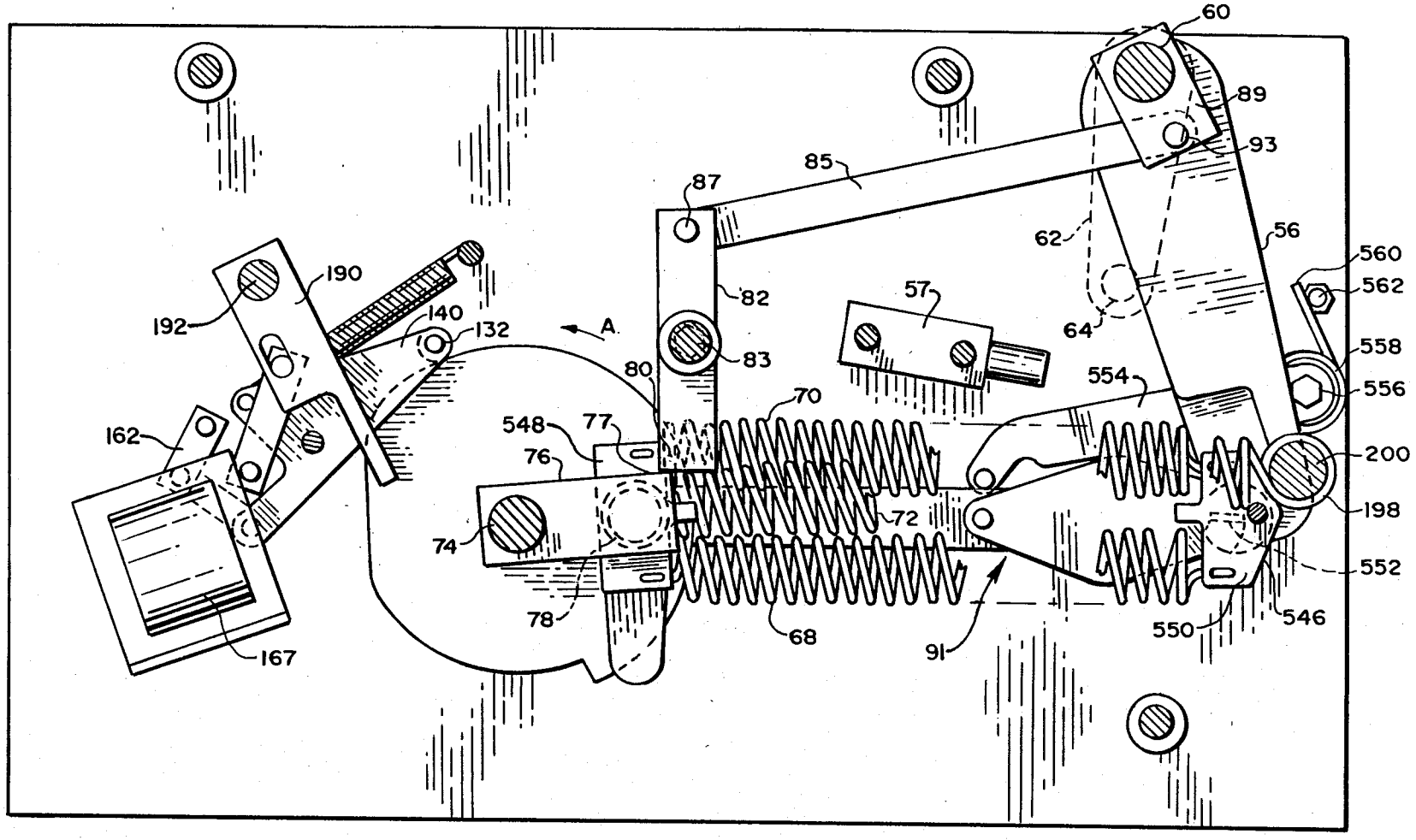
FIG. 7 shows the same mechanism as shown in FIGS. 5 and 6, but in the position wherein the switchgear operating mechanism has closed the contacts of the circuit interrupters.

Referring to FIGS. 5, 6, and 7, bar 44 is caused to reciprocate by rotation of an arm 56 which is secured for rotation with shaft 60 Rotation of arm 56 and shaft 60 cause rotation of an arm 62 which is also secured for rotation with shaft 60. Arm 62 is shown in FIGS. 2, 5, 6, and 7. A pivot pin passing through a hole 64 in arm 62 and hole a 66 in bar 44, as shown in FIG. 2, causes the bar 44 to reciprocate upon rotation of arm 56 and shaft 60. Rotation of arm 56 is caused by forces applied to it through release of energy stored in extended helical springs 68, 70, and 72, as shown in FIG. 6.

Springs 68 and 70 which store energy for opening the interrupter contacts and spring 72 which stores energy for closing the interrupter contacts, are elongated, to store energy therein, by rotation of a drive shaft 74, to the position shown in FIG. 6. An arm 76 is secured, adjacent one of its ends, for rotation with the drive shaft 74. The other end of arm 76 is secured to a shaft 78, which as viewed in FIGS. 5, 6, and 7, extends into the paper and is supported at its other end by an arm similar to arm 76. The latter arm, similar to arm 76, is supported for rotation on the switch housing at a location in alignment with the drive shaft 74, which is also supported for rotation on the switch housing.

To charge both of the opening springs 68 and 70 and the closing spring 72, the drive shaft 74 is rotated in the direction of the arrow "A" shown in FIGS. 5, 6, and 7. Prior to charging of the springs, arms 56 and 76 are in the positions shown in FIG. 5. Rotation of the drive shaft 74 in the direction of the arrow "A" causes the arm 76 to move from the position shown in FIG. 5, to the position shown in FIG. 6. FIG. 6 illustrates the positions of the opening and closing springs just after reaching their fully charged or elongated condition. With the springs in their fully charged condition, the center of shaft 78, is slightly below the center of the drive shaft 74, as viewed in FIG. 6, such that when permitted to turn, the drive shaft will continue to rotate in the direction of the arrow "A" due to the force applied to it through arm 76 by closing spring 72.

Further rotation of the drive shaft 74, from the fully charged position of the springs, as shown in FIG. 6, is prevented, so as to maintain the springs in their fully charged condition, by engagement of an edge 77 of the arm 76 with a notch 86 in a lever arm 88. To release the drive shaft 74, for continued rotation in the direction of the arrow "A" under the applied force of the charged closing spring 72, lever 88 is caused to rotate in the direction of the arrow B around pivot point 90, as shown in FIG. 6. The closing of the circuit breaker contacts is brought about by rotation of lever 88 in the direction of arrow "B", so as to release edge 77 of arm 76 from notch 86 in lever arm 88, so as to permit shaft 74 to rotate in the direction of arrow "A".

A collapsible linkage 91, shown in detail in FIGS. 16, 17, 18 and 19, extends between shaft 78 and the free end of arm 56 (i.e., the end of arm 56 which is opposite the end secured for rotation with shaft 60). With the collapsible linkage 91 in its locked or rigid configuration, rotation of drive shaft 74 in the direction of the arrow "A", under the force of closing spring 72, will cause arm 56 to be rotated in the direction of arrow "C". Rotation of shaft 60 in the direction of arrow "C", causes arm 62 to also rotate in the direction of the arrow "C". This rotation of arm 62 will cause bar 44 to move to the right, as viewed in FIG. 2, because of the force applied to bar 44 through the pivot pin passing through hole 64 in arm 62 and hole 66 in bar 44. Because of the rigid configuration of the collapsible linkage 91 between shaft 78 and the free end of arm 56, opening springs 68 and 70 are maintained in their elongated or charged position, even though shaft 74 has rotated in the direction of arrow "A" and shaft 60 has rotated in the direction of arrow "C".

The rotation of the drive shaft 74 in the direction of the arrow A is stopped at the position shown in FIG. 7 by the engagement of edge 77 of arm 76 with end 80 of pivotal arm 82. Pivotal arm 82 is supported near its center by pivot pin 83. A lever 85 is pivotally connected by a pin 87 to the end of pivotal arm 82 opposite end 80. A lever 89 is secured to shaft 60 for rotation therewith, and is pivotally connected near its free end by a pin 93 to the end of lever 85 opposite the end connected by pivot pin 87 to pivotal arm 82. It will be observed by making reference to FIGS. 6 and 7, that as drive shaft 74 rotates from the reset position shown in FIG. 6 to the closed position shown in FIG. 7, that the pivotal arm 82 is rotated in a counterclockwise direction, such that end 80 is positioned to engage the edge 77 of arm 76 to prevent its further rotation in the direction "A". Following the just described rotations of shafts 74 and 60, the position of the shafts and related operating mechanism is that shown in FIG. 7. FIG. 7 illustrates the position of the components of the operating mechanism when the circuit breaker contacts are in their closed positions.

To open the circuit interrupter contacts it is necessary to move bar 44 to the left, as viewed in FIG. 2. This is accomplished by permitting the collapsible linkage 91 between shaft 78 and the free end of arm 56 to collapse, so as to permit springs 68 and 70 to rotate arm 56 in a direction opposite to that of arrow "C". Collapse of the collapsible linkage 91 is brought about by rotation of the operating handle 34 from the "close" through the "reset" to the "trip" position. Following the collapse of the collapsible linkage 91, the circuit breaker contacts move to their open positions and the components of the operating mechanism assure the positions shown in FIG. 5.

The operation of the previously mentioned collapsible linkage 91 will now be described by making reference to FIGS. 16, 17, 18, and 19. The collapsible linkage 91 includes an L-shaped lever 502 which is pivotally attached by a pin 504 between a spaced apart pair of diamond shaped plates 506 and 508. The diamond shaped plates are secured to each other in a spaced apart relationship by pins 510 and 512. A pair of holes 514 and 516 are provided in plates 506 and 508, respectively, for receiving and supporting a shaft 518. The portion of the shaft 518 between the plates 506 and 508 is formed as a semicircular shaped cam 520. A portion of the shaft 518 extends outwardly beyond plate 508 and supports a lever 522 which is secured for rotation with shaft 518. The central portion of a helical spring 524 is wrapped around the shaft 518 with one end 526 of the spring engaging the edge of a hole 528 provided in the lever 522, and a second end 530 engaging a notch 532 in an extension of a pin 533 which is secured to the plates 506 and 508. The helical spring 524 biases the cam 520 to the position shown in FIGS. 16, 17, and 18.

Figure 17:
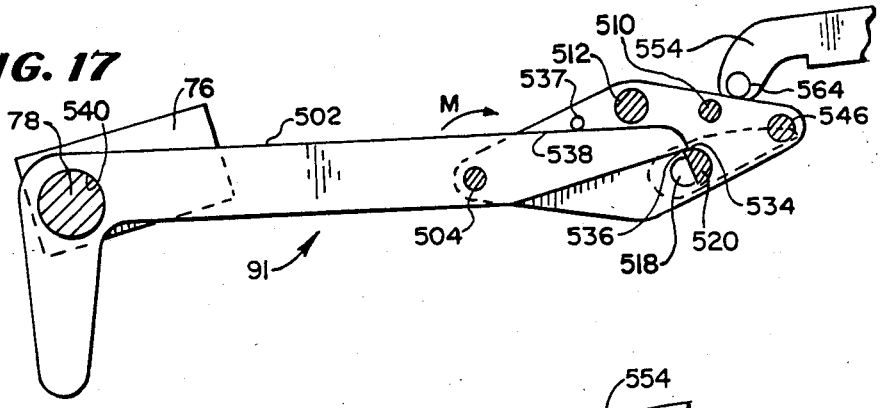
FIG 17 is a top elevation view of the collapsible linkage shown in FIG. 16 in its rigid condition and the operating mechanism is reset.
Figure 18:
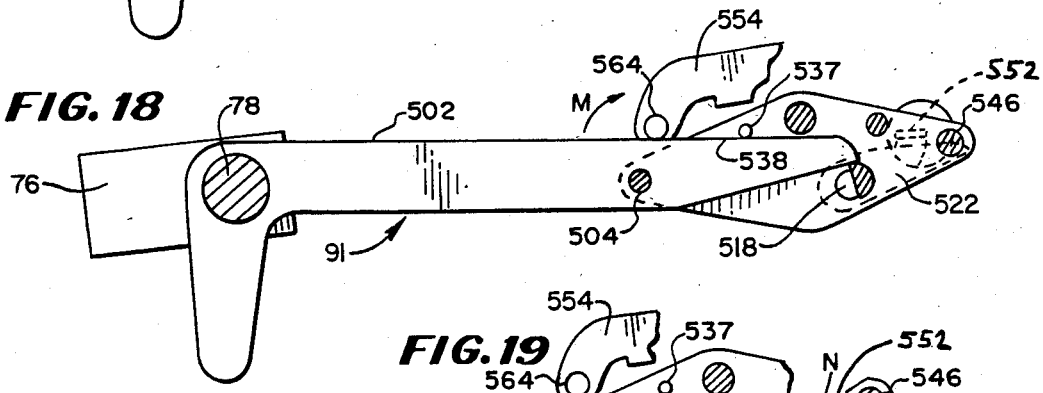
FIG. 18 is a top elevation view of the collapsible linkage shown in FIG. 16 in its rigid condition and the switch contacts are closed.

As shown in FIGS. 17 and 18, an edge 534 of the cam 520 engages an edge 536 of the lever 502, to prevent clockwise rotation of lever arm 502, around the pin 504, with respect to plates 506 and 508. Such clockwise rotation is represented by the letter "M" in FIGS. 16 through 20. The engagement of a pin 537 with an edge 538 of the lever arm 502 prevents rotation of the lever arm 502 with respect to plates 506 and 508 in a direction opposite to arrow "M". Thus, lever arm 502 and plates 506 and 508 are maintained in a rigid position with respect to each other, such that a fixed distance is maintained between a hole 540 in the knee of the L-shaped lever 502 and aligned holes 542 and 544 in the diamond shaped plates 506 and 508.

As shown in FIGS. 6 and 17, 18 and 20, shaft 78 is received in hole 540 of lever arm 502 and a pin 546, passing through a hole 547 in the free end of the lever 56, is received in holes 542 and 544 in plates 506 and 508. Motion of arm 56 is limited by an adjustable stop 57. Thus, the collapsible linkage 91, while in its rigid configuration, maintains a predetermined spacing between the shaft 78 and the pin 546 to maintain the opening springs 68 and 70 in their charged condition. As viewed in FIG. 6, the left ends of opening springs 68 and 70 are secured to a plate 548 which is provided with hole which receives shaft 78, and the opposite or right ends are secured to a plate 550, which is provided witn a hole which receives the pin 546.

Figure 19:
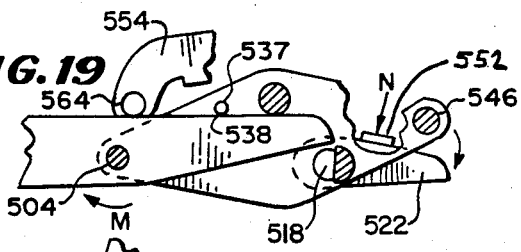
FIG. 19 is a fragmentary top elevation view of the collapsible linkage shown in FIGS. 16 through 18, just after its release mechanism has been actuated to provide for its collapse, but prior to collapse.
Figure 20:
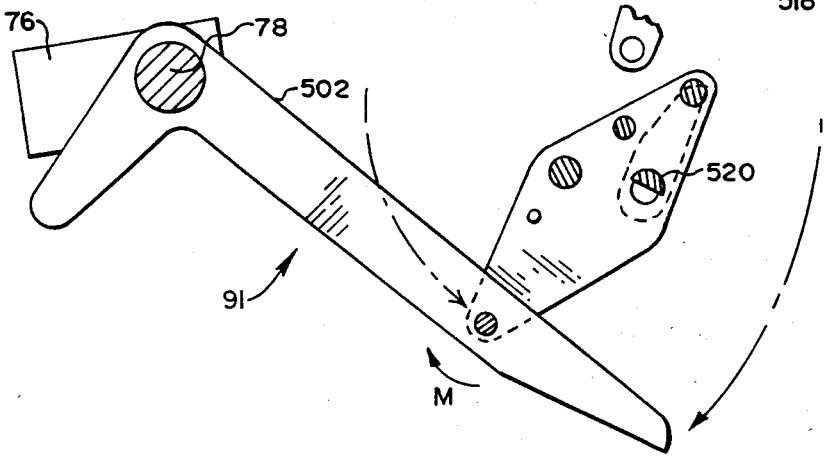
FIG. 20 is a top elevation view of the collapsible linkage mechanism shown in FIGS. 16 through 19, in its collapsed condition.

Collapse of the collapsible linkage 91 is brought about by the engagement of an operating tab 552, shown in FIGS. 6, 18 and 19, with an edge of lever 522. When it is desired to collapse the linkage 91 to release the energy in the opening springs 68 and 70 to open the interrupter contacts, the lever 552 is moved in the direction of the arrow "N" in FIG. 19, to rotate the lever 522 in a clockwise direction to move the edge 534 of the cam 520 out of engagement with the corresponding edge 536 of the L-shaped lever 502 (See FIG. 17). To assist is the collapse of the linkage 91, a force is applied to the upper edge of the lever 502, as viewed in FIGS. 6, 18 and 19, near pivot pin 504 to cause the rotation of the lever 50 in the direction "M" with respect to the plates 506 and 508. As shown in FIGS. 6 and 18, this force is applied by a lever 554 which is pivotally supported from a wall of the cabinet by a fixed pivot pin 556 which is secured on the switch housing. The central portion of a helical spring 558 encircles the pin 556 with one free end 560 engaging a fixed pin 562 and the other end engaging the lever 554 to cause it to rotate in the direction of the arrow "P" about the pivot pin 556. A pin 564 at the free end of lever 554 engages the upper edge of L-shaped lever 502, as shown in FIGS. 18 and 19, to cause the collapsible linkage 91 to collapse by rotation of the lever 502 with respect to the plates 506 and 508 in the direction of the arrow "M" about pivot pin 504, to the position shown in FIG. 20.

Charging Mechanism

The mechanism for rotating the drive shaft 74, so as to charge opening springs 68 and 70 and closing spring 72, will be described by making reference to FIGS. 3, 4, 8, and 9. Drive shaft 74 is connected to a pair of levers 92 and 94 (See FIG. 8) by a ratchet-type one-way (i.e., overrunning) clutch 95, whereby the movement of the levers 92 and 94 in the direction of the arrow "D" will result in the rotation of the drive shaft 74 in the same direction. Rotation of the levers 92 and 94 in the direction opposite to that of arrow "D" does not result in rotation of drive shaft 74, whereby the clutch is engaged only in the direction of arrow "D". Still another ratchet-type clutch 97 is housed within a hub which hub is rigidly secured to a wall 109. The purpose of this clutch 97 is to prevent reverse rotation of the drive shaft 74 (opposite arrow "D"), while the clutch 95 and levers 92 and 94 ar indexed in the reverse direction into position for the next incremental rotation of drive shaft 74 in the direction of the arrow "D".

Levers 92 and 94 are rotated in the direction of arrow "D" by pulling an operating shaft 96, joined to handle 32, in the direction of arrow "E". A pair of links 98 and 100 are each pivotally connected at one end to a collar 102 which is secured to shaft 96. Links 98 and 100 are pivotally connected to a pair of moveable triangular shaped members 104 and 106 by pins, one of which 108 is shown (See FIG. 8). These triangular shaped members 104 and 106 are pivotally supported on the switch housing wall 109 by a second set of fixed triangular shaped members 110 and 112 which are attached to the housing wall 109. The moveable triangular shaped members 104 and 106 are pivotally supported by a pin 113 carried by the fixed triangular shaped members 110 and 112.

Movement of the shaft 96 in the direction of the arrow "E" results in rotation of the moveable triangular members 104 and 106 about pin 113 in the direction of arrow "F". Rotation of the triangular shaped members 104 and 106 in the direction of arrow "F" results in movement of a rod 114 (See FIGS. 3 and 4) in the direction of arrow "G". Rod 114 is pivotally secured to the movable triangular shaped members 104 and 106 by a pivot pin 115. Rod 114 is also pivotally connected by a spring biased pin 116 to a pair of levers 118 and 120 and a pair of links 122 and 124. Levers 118 and 120 are pivotally supported at one end on housing wall 109 by a pin 121. Links 122 and 124 are further pivotally connected by an upwardly (according to the orientation of FIGS. 3 and 4) biased pin 125 to a second pair of links 126 and 128. These links 126 and 128 are pivotally connected by a pin 130 to the free ends of levers 92 and 94.

Figure 3:
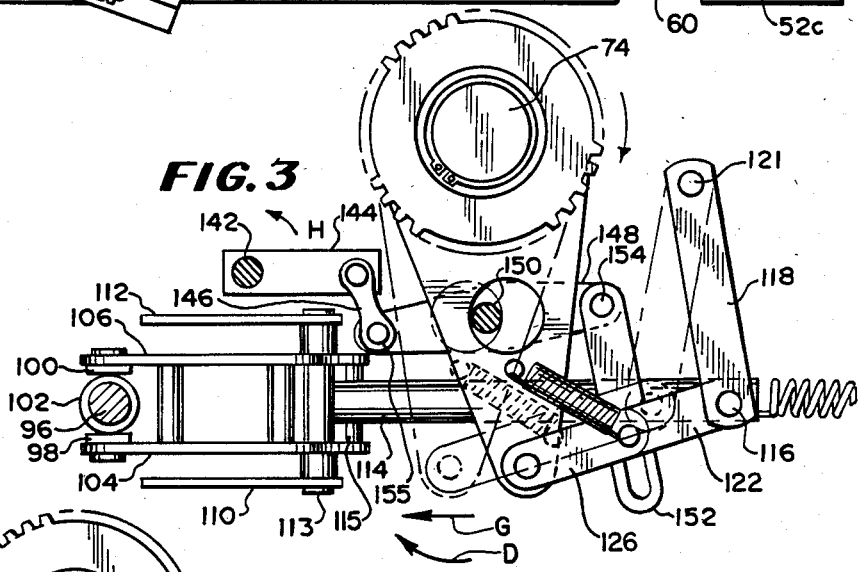
FIG. 3 is a side elevational view of that portion of the switchgear operating mechanism which converts reciprocating motion into rotary motion, shown in its effective or operative condition.
Figure 8:
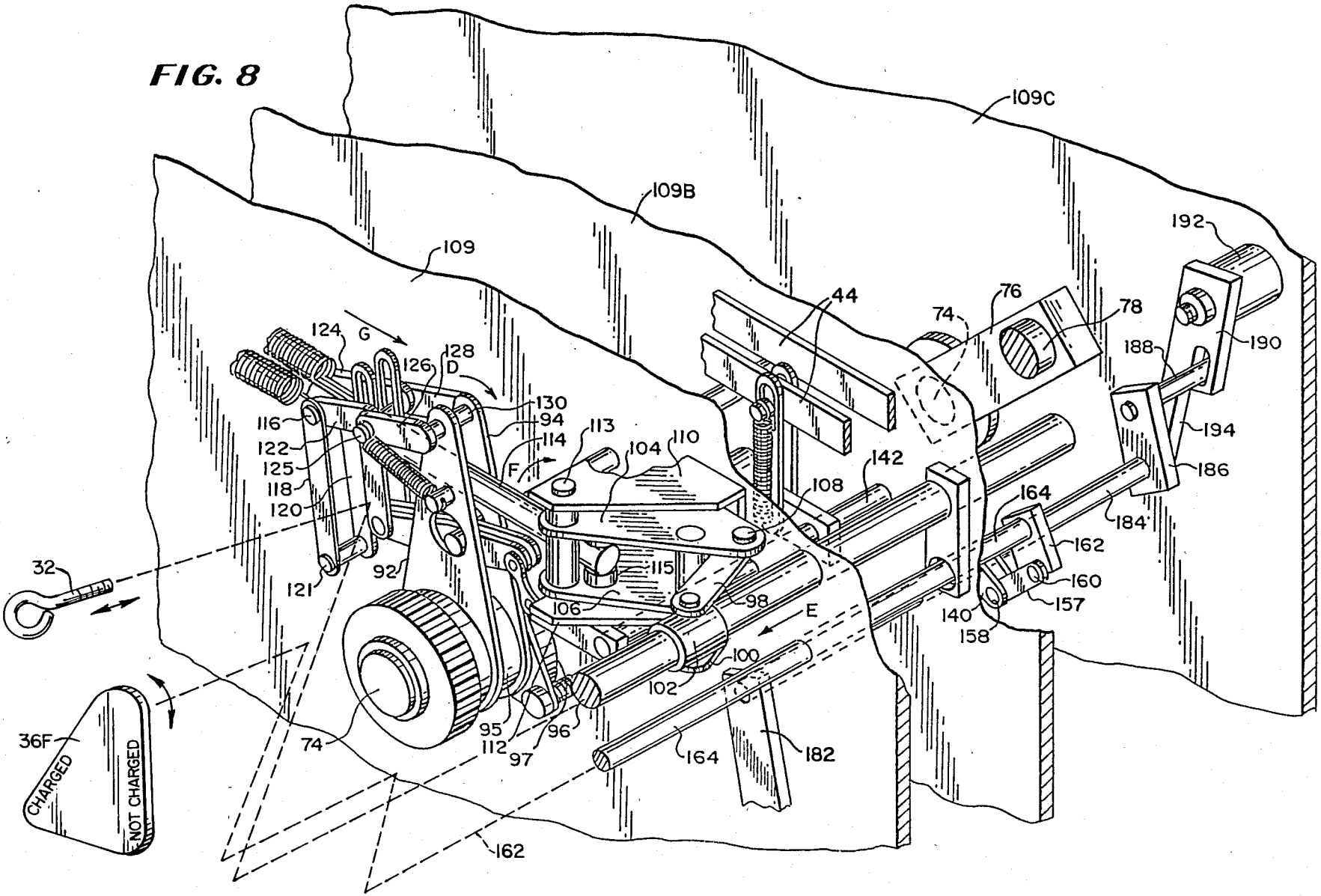
FIG. 8 is a perspective view of that portion of the switchgear operating mechanism wherein linear motion is converted to rotary motion and the mechanism for actuating the switchgear mechanism from the reset to the closed position.
Figure 9:
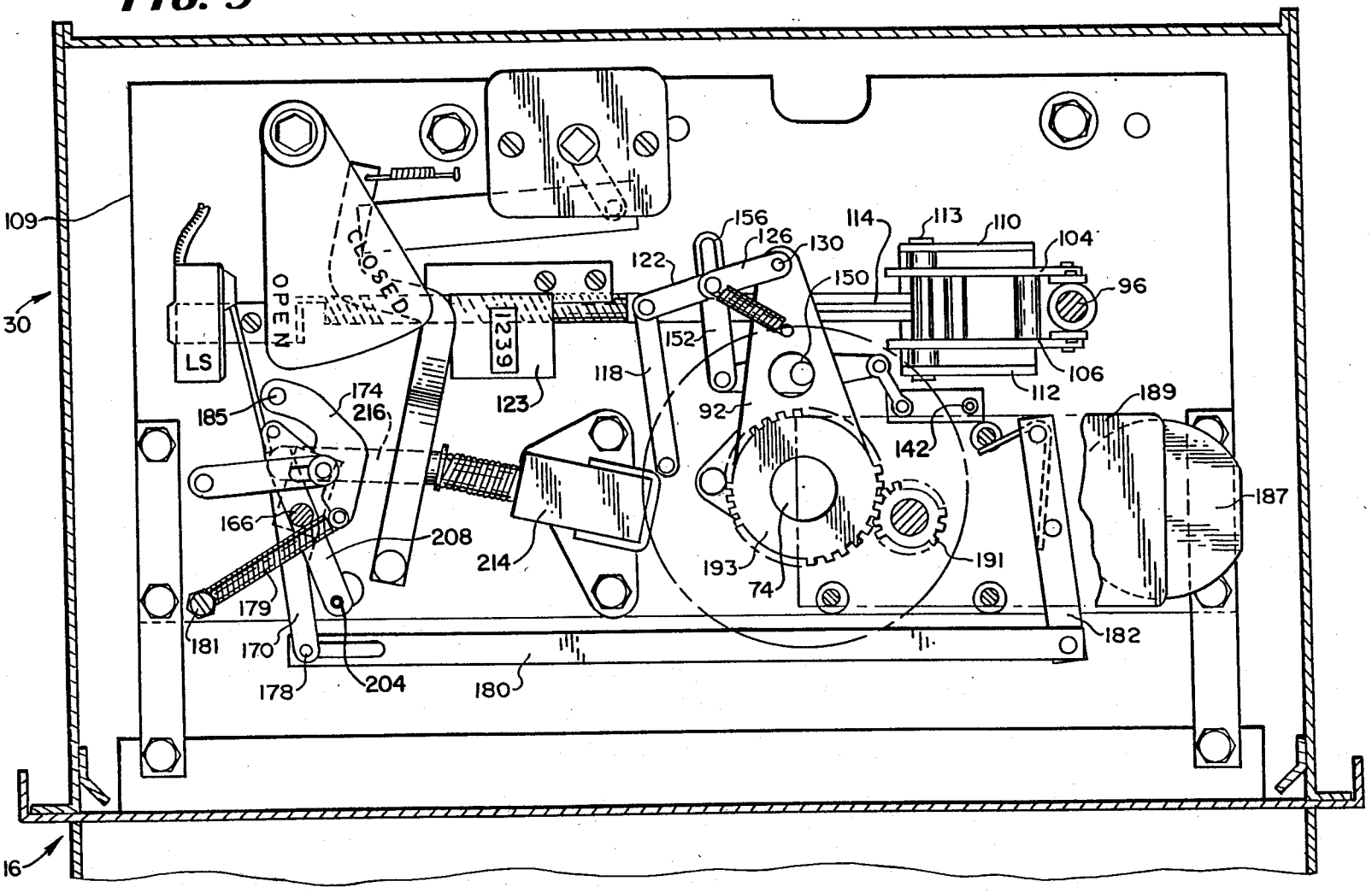
FIG. 9 is a front elevation view of the portion of the switchgear operating mechanism shown in FIG. 8, and of additional mechanism associated with the operating means.

With links 122 and 124 and links 126 and 128 in the position shown in FIG. 8, movement of the operating shaft 96 in the direction of the arrow "E" will result in rotation of the levers 92 and 94, and rotation of drive shaft 74 in the direction of the arrow "D". With the levers 122 and 124 and 126 and 128 maintained in the positions shown in FIG. 8, reciprocating movement of the operating shaft 96 will cause the drive shaft 74 to be incrementally rotated in the direction of the arrow "D" each time the operating shaft 96 is moved in the direction of the arrow "E". The position of the lever arms 122 and 124 and 126 and 128, as shown in FIG. 8, is also depicted in FIG. 3. In the embodiment depicted in the drawings approximately 20 to 30 strokes of a hook stick were needed to change the two springs. This is in marked contrast with those devices where approximately 250 to 350 hand crank revolutions were needed to charge. Moreover, it is much easier and safer to use a hook stick which can readily be used at a distance from the interrupted cabinet.

Referring to FIG. 6, when the drive shaft 74 has been rotated to the fully charged position of the springs 68, 70 and 72, a cam follower 132 resting on a cam surface of a cam 134 secured to drive shaft 74 will drop from a high portion 136 of the cam to a low portion 138 of the cam. This movement of cam follower 132, will cause a lever 140, which pivotally supports cam follower 132 to rotate in the direction of arrow "H" about its pivot point, which is the center of a shaft 142 to which it is connected.

Figure 4:
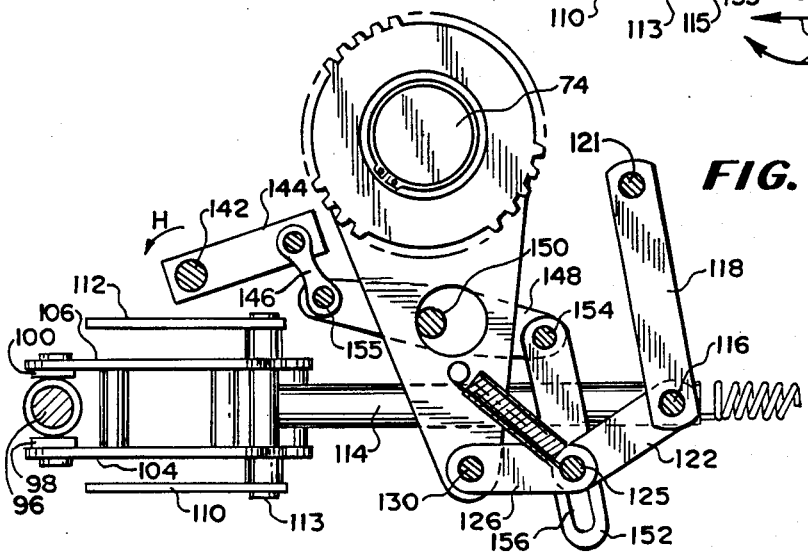
FIG. 4 depicts the same portion of the switchgear operating mechanism as shown in FIG. 3, but in its inoperative or ineffective configuration.

Referring to FIGS. 3 and 4, rotation of the shaft 142 in the direction of the arrow "H", from the position shown in FIG. 3 to that shown in FIG. 4, causes rotation of a lever arm 144, which is connected to shaft 142 from the position shown in FIG. 3, to that shown in FIG. 4. Rotation of lever arm 144 in the direction of arrow "H" is transmitted through a pair of linking members 146 to a pair of lever arm 148 which are pivotally supported on housing wall 109 by a pin 150. Another pair of links 152 are secured by a pivot pin 154 to the end of lever arms 148 opposite that to which linking members 146 are pivotally secured by a pivot pin 155. Movement of lever arm 144 in the direction of arrow "H" in FIG. 3, results in a downward movement of links 152 from the position shown in FIG. 3, to that shown in FIG. 4. This downward movement of links 152 results in the links 122 and 124, and links 126 and 128 being forced out (in opposition to biased pin 125) of alignment (i.e., from the position shown in FIG. 3 to that shown in FIG. 4), such that further reciprocating motion of the operating shaft 96 is not transmitted to the levers 92 and 94, but rather results only in the pin 125 moving within slots 156 in the links 152.

At the same time that the linkage causing rotation of the shaft 74 by reciprocation of the operating shaft 96 in the direction of arrow "E" is disabled, an indicating mechanism provides an indication (See window 36 in FIG. 1) that the springs 68, 70 and 72 are charged. As shown in FIGS. 5 and 8, a link 157 is pivotally secured to cam follower lever 140 by a pivot pin 158. Movement of link 157 is transmitted through a pivot pin 160 to a lever 162, as shown in FIG. 8. Lever 162 is secured for rotation with a shaft 164 which is in turn connected to a flag 36F exposed by a window 36 (See FIG. 1) which indicates by its rotational position whether the closing and opening springs are charged or discharged.

Drive shaft 74 may also be rotated in the direction of the arrow "D" by energizing a motor 187 (See FIG. 9) which rotates the drive shaft through a gear train 189 and output gear 191. The output gear 191 engages a gear 193 which secured to the drive shaft 74.

Operation

Figure 10:
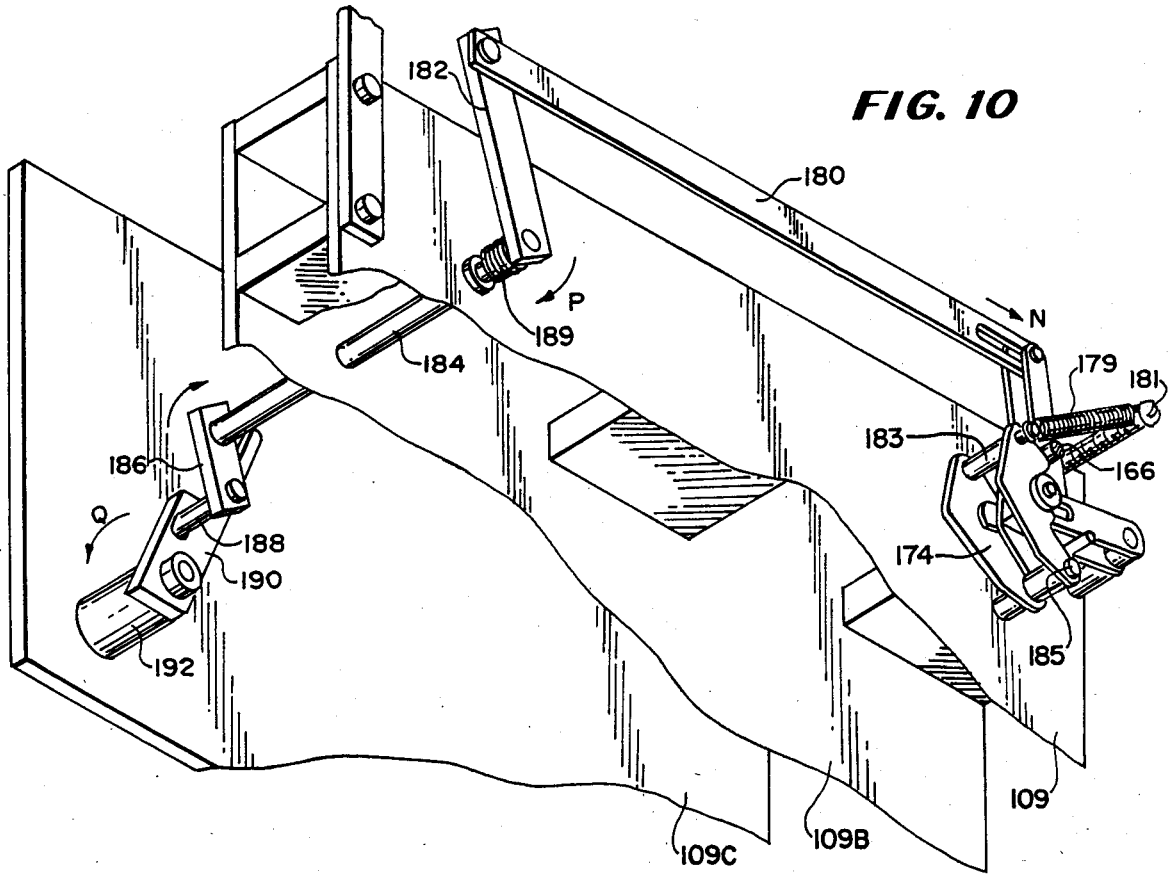
FIG. 10 is a perspective view of the mechanism which connects the operating handle with the switch operating mechanism.
Figure 11:
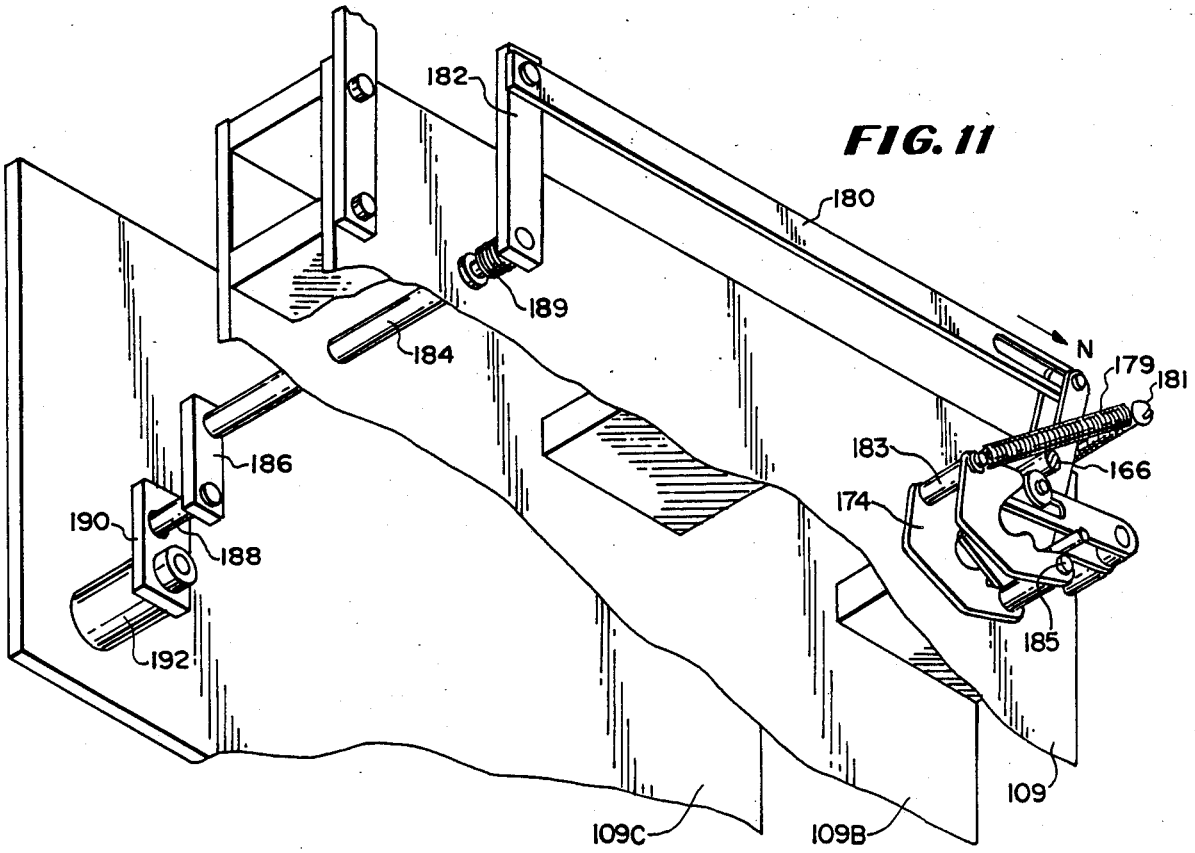
FIG. 11 shows the same mechanism as in FIG. 10, but with the mechanism in the position wherein the circuit breaker contacts are actuated to the closed position.

The closing of the circuit interrupter contacts is brought about by turning operating handle 34, as shown in FIG. 1, from the "reset" to the "close" position. Operating handle 34 is provided with an eye for operation by a hook stick. Handle 34 is connected as a lever arm to an operating shaft 166, as shoWn in FIGS. 9 through 15. During the charging of springs 68, 70 and 72, the switch actuating linkage may be in either the position shown in FIG. 13, or that shown in FIG. 14. Movement of operating handle 34 from the trip to the reset position, as viewed in FIG. 1, causes operating shaft 166 to rotate in a counter clockwise direction, as indicated by the arrow "M" in FIGS. 12, 13 and 14. As the operating handle 34 is moved from the trip to the reset position, rollers 168, which are rotatably mounted on operating lever 170 and which are in turn secured for rotation with shaft 166, move from resting on a high point 172 on a cam lever 174, as shown in FIG. 13, to a low point 176, as shown in FIGS. 10 and 14. The position of the lever 170, shown in FIG. 14, corresponds to the reset position of the operating handle 34. The trip position of the operating handle 34 corresponds to the position of the lever 170, shown in FIG. 13.

The combination of the cam surfaces on cam lever 174, engaging roller 168 and a biasing force holding the cam lever in engagement with the roller provides a detent and spring return for operating shaft 166 and operating handle 34. The biasing force is applied to the cam lever 174 by a helical spring 179, one end of which is secured to the housing wall by a pin 181, and the other end of which engages a pin 183 secured in the free end of cam lever 174, opposite the end pivotally supported on pin 185 which is supported on the housing wall (See FIGS. 9 and 10).

Rotation of the operating handle 34 from the reset to the closed position results in the rotation of the shaft 166 in a direction opposite that shown by the arrow "M" in FIGS. 12, 13 and 14. As the shaft 166 is rotated in the direction opposite the arrow "M", from the reset position shown in FIG. 14 to the closed position shown in FIG. 12, operating lever 180 is moved in the direction of the arrow "N". As viewed in FIGS. 10 and 11, movement of the operating lever 180 in the direction of the arrow "N" causes a pivot arm 182 to be rotated in the direction of arrow "P". Pivot arm 182 is secured or keyed to a shaft 184, such that rotation of the shaft 166 in the direction opposite to that shown by the arrow "M" causes rotation of the shaft 184 in the direction of the arrow "P". Spring 189 maintains arm 182 at a spaced distanced from wall 109. A lever 186 secured to the end of shaft 184 (See FIG. 8) opposite lever 182 is also rotated in the direction of the arrow "P", such that a pin 188 mounted at the free end of lever 186 will cause a lever 190, which is pivotally supported by a fixed pin 192, to rotate in the direction of the arrow "Q". Thus, movement of the operating handle from the reset to the closed position causes the mechanism just described to move from the position shown in FIG. 10, to that shown in FIG. 11.

Referring now to FIG. 6, the rotation of lever 190 in the direction of the arrow "Q" causes its free end 194 to engage the pin 196 on the free end of lever arm 88 to cause it to be rotated in the direction of the arrow "B". This in turn moves the notch 86 away from edge 77, thereby freeing drive shaft 74 to rotate in the direction of arrow "A". Rotation of the drive shaft 74 in the direction of the arrow "A" is caused by the force applied to it through the arm 76 by closing spring 72. That is, the closing spring 72, one end of which 198 is anchored to the housing by a pin 200, causes the shaft 78 to be rotated toward pin 200. The rotation of drive shaft 74 in the direction of arrow "A" in turn causes the rotation of the arm 56 in the direction of the arrow "C". This rotation of arm 56 is brought about through collapsible linkage 91 while in its rigid configuration. Movement of shaft 78 through rotation of drive shaft 74 is transmitted through a pin 546 to the free end of arm 56 to cause its rotation in the direction of the arrow "C". Rotation of arm 62 in the direction of arrow C causes movement of the pin 64, and therefore of bar 44 to the right, as shown in FIG. 2, to actuate rods 38, 40, and 42 to close the circuit breaker contacts.

Closing of the circuit interrupter contacts may also be brought about electrically by energizing a solenoid 167 shown in FIGS. 5, 6, and 7. The armature of solenoid 167 is connected by a suitable linkage (shown in phantom at 300 in FIG. 5) to lever 190 to cause lever 190 to rotate in the direction of arrow "Q" when solenoid 167 is energized. As previously described, the rotation of lever 190 in the direction of arrow "Q" brings about the closing of the circuit breaker contacts.

Opening of the contacts is brought about through rotation of the operating handle 34, as shown in FIG. 1, to the trip position. Rotation of the operating handle 34 and shaft 166 from the closed position shown in FIG. 12, to the trip position shown in FIG. 13, is transmitted through a linkage mechanism to the operating tab 552, as shown in FIG. 19, to cause collapse of the collapsible linkage 91.

Figure 15:
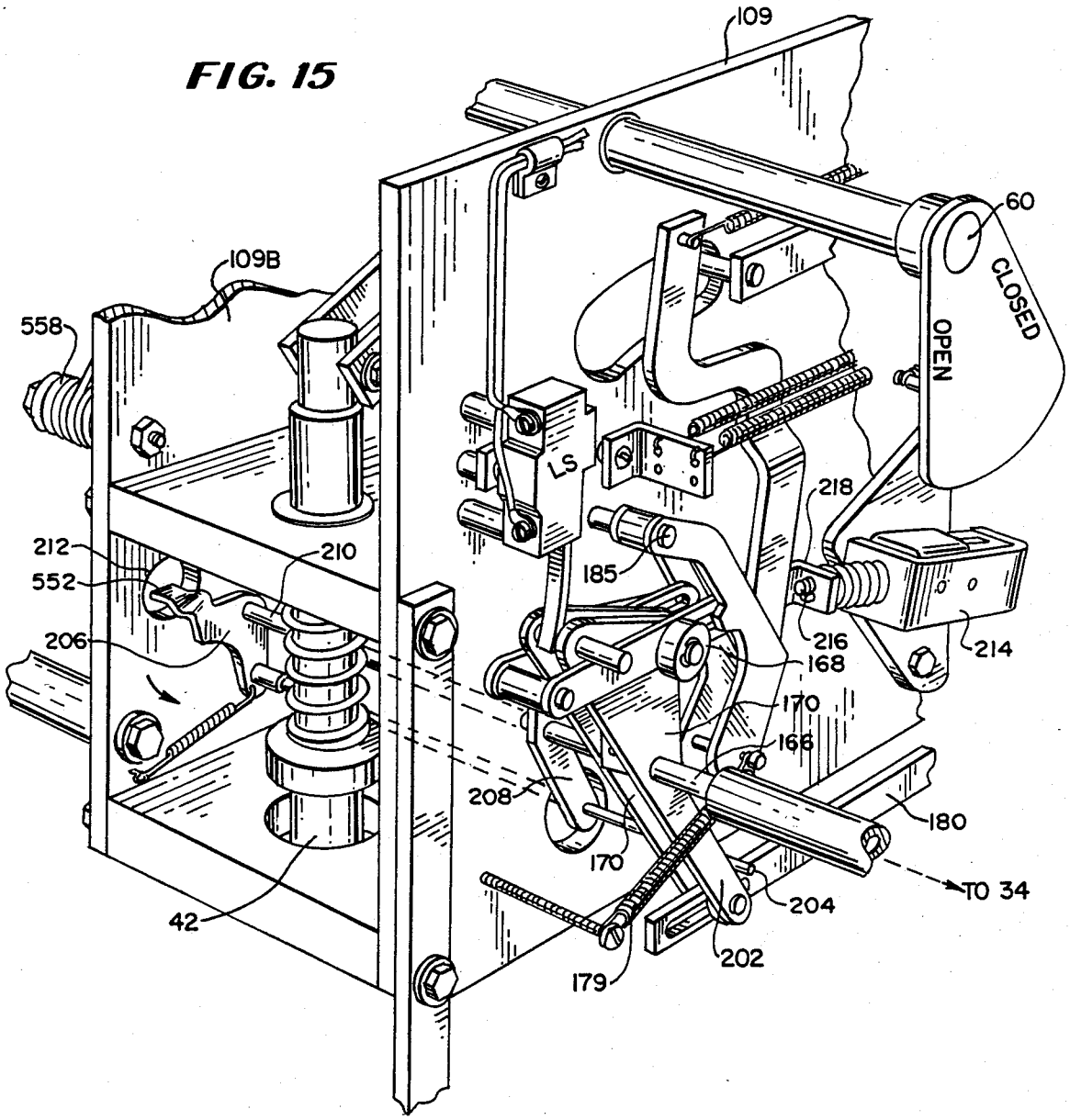
FIG. 15 is a perspective view showing the mechanism of FIGS. 12 through 14, as well as a portion of the mechanism which brings about the opening of the circuit breaker contacts.
Figure 16:
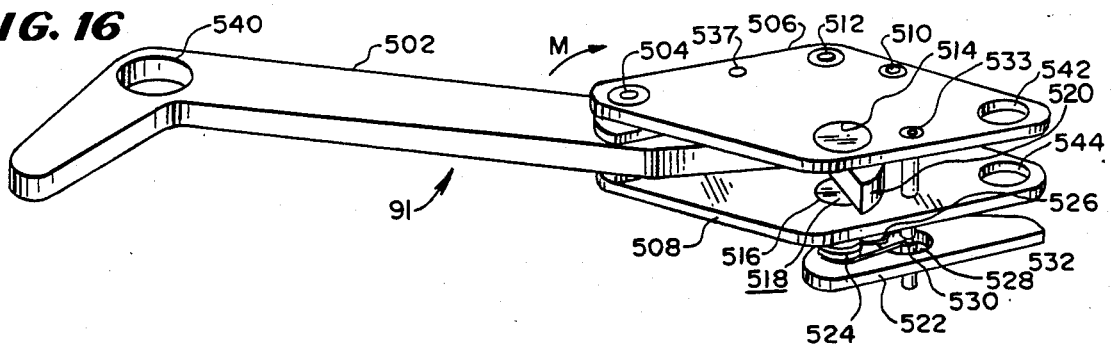
FIG. 16 is a perspective view of the collapsible linkage assembly which is also shown in FIGS. 5, 6, and 7.

Referring to FIG. 13 and 14, as the operating shaft 166 is rotated in the direction of the letter "M", edge 202 of operating lever 170 engages a rod 204 causing the rod to move to the left, as viewed in FIGS. 13 and 14. Referring to FIG. 15, rod 204 is secured to the free ends of a pair of spring biased levers 206 and 208, both of which are pivotally mounted upon a shaft 210, which is supported on the switch housing and which is an extension of operating shaft 166. Tab 552, which extends through an aperture 212 in the switch wall housing is formed as a part of lever 206. Movement of rod 204 to the left, as viewed in FIGS. 13 and 14, corresponds to movement of rod 204 in a counterclockwise direction about the shaft 210. Thus, movement of the operating handle 34 to the trip position results in a downward movement of the tab 552, as viewed in FIG. 15. The downward movement of the tab 552 in FIG. 15 corresponds to movement of the tab 552 in the direction of the arrow "N" in FIG. 19. As previously explained, movement of the lever 552 in the direction of the arrow "N" results in collapse of the linkage 91. Collapse of the linkage 91 allows the closing spring 68 and 70 to apply a force through pin 546 to cause the arm 56 to rotate in a counter-clockwise direction, as viewed in FIGS. 5, 6, and 7, from the closed position shown in FIG. 7, to the open or trip position shown in FIG. 5. The collapsible linkage 91 is shown in its collapsed configuration in FIG. 5.

Opening of the circuit breaker contacts may also be brought about electrically by electrical actuation of a flux shift tripper 214 shown in FIG. 15. Operating shaft 216 of flux shift tripper 214 is connected by a linkage, including lever 218, to rotate lever 208 to cause downward movement of tab 552 and opening of the circuit breaker contacts as previously described.

Finally, it should be noted that limit switches LS, safety devices, monitoring switches, and other conventional components equipment are included to provide remote indication and control of the interrupter.

CONCLUSION

From the foregoing description, it will be observed that numerous variations and modifications may be effected without departing from the true spirit and scope of the novel concept of the invention. For example, additional accessories may be provided to monitor and control the operation of various components or interlocks can be provided to add additional safety. Moreover, one or more of the features of the embodiment illustrated can be combined in other mechanisms and need not necessarily be combined in the specific manner described. Thus, it should be understood that no limitation with respect to the specific apparatus illustrated herein is intended or inferred It is, of course, intended to cover by the appended claims all such modifications as fall within the scope of the claims.

We claim:

1. In a switchgear having contact means for causing movement of at least one first contact relative to at least one second contact so as to engage and disengage said contacts to open and close an electrical circuit therebetween, an operating mechanism, comprising:

first resilient yieldable means for storing energy to engage said first and second contacts through said contact means;

second resilient yieldable means for storing energy to disengage said first and second contacts through said contact means;

a rotatable member, coupled to one end of said first resilient yieldable means and to one end of said second resilient yieldable means, for stressing said first resilient yieldable means and said second resilient yieldable means to store energy therein said rotatable member being mounted for movement through 360 degrees of rotation in one direction;

charging means, operating in response to a plurality of reciprocating strokes from a hook stick, for rotating said rotatable member in said one direction through a first predetermined arc of rotation to a first rotated position and releasably holding said rotatable member in said first rotated position to stress said first resilient yieldable means and said second resilient yieldable means; and operating handle means, operable by at least one stroke of a hook stick and having a first position and a second position, for releasing energy stored in the first resilient yieldable means to engage said first and said second contacts by releasing said rotatable member from said first rotated position for continued rotation in said one direction through a second predetermined arc of rotation to a second rotated position when said handle means is moved by said hook stick to said first position, and for releasing energy stored in said second resilient yieldable means to disengage said first and said second contacts when said handle means is moved by a hook stick to said second position.

2. The switchgear operating mechanism of claim 1, wherein said charging means includes: a charging member which is engaged and operated by said hook stick; and motion translation means, operating in response to reciprocating motion of said charging member in a direction generally parallel to the axis of rotation of said rotatable member, for causing rotation of said rotatable member in said one direction for stressing said first resilient yieldable means and said second resilient yieldable means.

3. The switchgear operating mechanism of claim 1, wherein charging means includes: lever means; a linkage assembly connected to said lever means and operated by said hook stick; and clutch means for connecting said rotatable member to said lever means, reciprocating motion of said hook stick in a first direction being translated through said linkage assembly, said lever means, and said clutch means to cause progressive and incremental rotation of said rotatable member in said one direction to said first rotated position and to stress said first resilient yieldable means and stress said second resilient yieldable means to store energy therein, said clutch means being connected to permit said lever means to move independent of said rotatable member when said hook stick is moved in a direction opposite said first direction.

4. The switchgear operating mechanism of claim 3, further including means for rendering ineffective said linkage assembly to further rotate said rotatable member when said rotatable member has been rotated to said first rotated position to stress said first resilient yieldable means and stress said second resilient yieldable means.

5. The switchgear operating mechanism of claim 1, wherein said charging means includes clutch means for preventing rotation of said rotatable member in a direction opposite to said one direction.

6. The switchgear operating mechanism of claim 1, wherein said operating handle means includes an operating handle which is mounted for movement to three positions and which is operated in response to said hook stick and includes spring and detent means for establishing three predetermined positions of said operating handle, the first predetermined position corresponding to said first position of said operating handle means to cause engagement of said contacts, the second predetermined position corresponding to said second position of said operating handle means to cause disengagement of said contacts, and the third predetermined position being a reset position, wherein said first resilient yieldable means and said second resilient yieldable means are not stressed.

7. The switchgear operating mechanism of claim 6, wherein said spring and detent means includes:

(a) engaging means, connected for movement with said operating handle, for engaging a camming surface;

(b) a lever having a pivotally mounted end, a free end, and a cam surface extending between said pivotally mounted end and said free end, said cam surface being formed to define a first detent position which is located adjacent said free end and which corresponds to said first predetermined position of said operating handle, a second detent position which is located intermediate the ends of said lever and which corresponds to said reset position of said operating handle, and a third detent position which is located adjacent said pivotally mounted end and which corresponds to said second predetermined position of said operating handle; and (c) yieldable biasing means, connected to the free end of said pivotally mounted lever, for providing a force to return said operating handle to said reset position from said first predetermined position after said contacts have been closed and for providing a force to retain said operating handle in said reset position after said operating handle has been moved to said second predetermined position to open said first and second contacts and has been returned to said reset position.

8. The switchgear operating mechanism of claim 2, further including: a spring and detent means is provided to establish three predetermined positions of said operating handle means corresponding to a first position to cause engagement of said contacts, a second position to cause disengagement of said contacts, and a reset position wherein said first yieldable means and said second yieldable means are not stressed.

9. The switchgear operating mechanism of claim 8, wherein said spring and detent means includes:

cam surface engaging means, connected for movement with said operating handle means, for engaging a cam surface;

a pivotally mounted lever having a pivotally mounted end, a free end, and a cam surface extending between said pivotally mounted end and said free end, said cam surface being formed to define a first detent position corresponding to said first position of said operating handle means, a second detent position corresponding to said reset position, and a third detent position corresponding to said second position of said operating handle means; and biasing means, connected to said pivotally mounted lever, for providing a force to return said operating handle means to said reset position from said first position after said first and second contacts have been closed and for providing a force to retain said operating handle means in said reset position after said operating handle has been moved to said second position to open said first and second contacts and has been returned to said reset position.

10. The switchgear operating mechanism of claim 1, wherein said first resilient yieldable means and said second resilient yieldable means are extensible helical springs and wherein said rotatable member is rotated less than one revolution in stressing said springs.

11. The switchgear operating mechanism of claim 1, wherein said operating handle means includes a collapsible linkage which is coupled at one end to said rotatable member and at the other end to said contact means and which has a rigid condition and a collapsed condition, said collapsible linkage, when in said rigid condition, maintaining said second resilient yieldable member in a stressed condition independent of the rotation of said rotatable member, movement of said operating handle means to said second position causing said collapsible linkage to change from said rigid condition to said collapsed condition to release the energy stored in said second resilient yieldable means and open said contact means.

12. The switchgear operating mechanism of claim 4, wherein said rotatable member includes latch means, having a first engaged position and a second disengaged position, for limiting the rotation of said rotatable member beyond said first rotated position when said latch means. is in its first engaged position, movement of said operating handle means to said first position being effective to move said latch means to said second disengaged position to permit further rotation of said rotatable member to release energy stored said first resilient means.

13. The switchgear operating mechanism of claim 1, wherein charging means includes: linkage means for translating a plurality of reciprocatory strokes from said hook stick to rotational motion; and one-way clutch means for transferring said rotational motion of said linkage means to operate said rotatable member in one direction of rotation.

14. In a switchgear for causing movement of at least one contact relative to at least another contact so as to engage and disengage the contacts to open and close a circuit therebetween, a mechanism comprising:

a first and a second helical extension spring which are stressed by extension thereof and which have their axis of extension generally parallel and along side each other, each spring having two ends;

a rotatable member coupled to said first and second springs and rotatable in a circle in one direction through two positions, rotation of said rotatable member to a first position having the effect of simultaneously stressing said first and second springs to store energy therein, said first spring having one end fixed and the other end joined radially to said rotatable member, said second spring having one end joined radially to said rotatable member;

a collapsible linkage having a rigid condition and a collapsed condition, said collapsible linkage when in its rigid condition maintaining said second spring in a stressed condition without regard to the position of said rotatable member, said linkage having two ends and being connected radially at one end to said rotatable member and being connected at its other end to the switchgear and the other end of said second spring, whereby rotation of said rotatable member is converted to linear motion of said linkage;

charging means, operable in response to a plurality of reciprocating strokes applied to a first handle, for causing rotation of said rotatable member to said first position for stressing said first and second springs and for moving said linkage from its collapsed condition to its rigid condition; and a second handle, having two positions, for operating said rotatable member after said rotatable member has been rotated to its first position, movement of said second handle to a first position being effective to release said rotatable member for continued rotation from said first position to its second position and to release energy stored in the first spring to cause the contacts to be engaged, and movement of said second handle to a second position being effective to cause said collapsible linkage to change from its rigid condition to its collapsed condition to release energy stored in said second spring and open the contacts.

15. In a switchgear for causing movement of at least one contact relative to at least another contact so as to engage and disengage the contacts to open and close an electrical circuit therebetween, a mechanism comprising:

first and second helical extension springs for storing energy to be used in engaging and disengaging said first and second contacts, said first and second helical extension springs being stressed by extension thereof and being disposed generally parallel to and spaced apart from each other, each spring having two ends.

a rotatable member, coupled to said first and second springs and rotatable in a circular path in one direction, for stressing said first and second springs to store energy therein when rotated to a first rotated position, said first helical extension spring having one end fixed and the other end joined radially to said rotatable member, said second helical extension spring having one end joined radially to said rotatable member;

a collapsible linkage, having a rigid condition and a collapsed condition, for maintaining said second spring in a stressed condition without regard to the position of said rotatable member when said collapsible linkage is in its rigid condition, said linkage having two ends and being connected radially at one end to said rotatable member and being connected at its other end to said switchgear contacts and the other end of said second spring, whereby rotation of said rotatable member is converted to linear motion of said linkage;

charging means, operable by a plurality of strokes from a hook stick, for rotating of said rotatable member to its first rotated position and for erecting said linkage to its rigid condition;

three position operating handle means, operable by a hook stick, for moving said rotatable member from said first rotated position to its second rotated position and to release energy stored in the first spring when said handle means is moved to a first handle position, and for causing said collapsible linkage to change from its rigid condition to its collapsed condition to release energy stored in said second spring when said handle means is moved to a second handle position; and bias and detent means for establishing three predetermined positions of said handle means, said positions corresponding to said first handle position to cause engagement of said contacts, to said second handle position to cause disengagement of said contacts, and to a reset position wherein said first and second springs are stressed to store energy, said bias and detent means including:

(a) cam surface engaging means, connected for movement with said handle means, for engaging a cam surface;

(b) a pivotally mounted lever having a pivotally mounted end and a free end, and having a cam surface extending between said pivotally mounted end and said free end of said pivotally mounted lever, said cam surface being formed to define a first detent position corresponding to said first handle position of said handle means, a second detent position corresponding to said reset position, and a third detent position corresponding to said second handle position of said handle means; and (c) yieldable biasing means connected to the free end of said pivotally mounted lever, said yieldable biasing means providing a force to return said handle means to said reset position from said first handle position after the contacts have been engaged and a force to return said handle means to said reset position from said second handle position after the contacts have been disengaged.

16. A switchgear operating mechanism, comprising:

(a) a frame;

(b) two extensible coil springs, each spring having two ends and arranged in a parallel side by side relation-ship to each other, one coil spring having one end fixed to said frame;

(c) a bell crank which is rotatable carried by said frame;

(d) a pair of switch contacts, one of said contacts being free to move towards and away from the other in response to said bell crank;

(e) collapsible linkage means for collapsing two links, each of said links having a common end and an opposite end, said common ends being pivoted to each other and said opposite ends being joined to the ends of the other coil spring, said other coil spring being extended when said links are erect and generally in line with each other and parallel to the axis of elongation of said other coil spring, one of said opposite ends of said two links being joined to a lever arm which is coupled to rotate said bell crank; and (f) conversion means, carried by said frame and connected to the other end of said one coil spring and to the other opposite end of said collapsible linkage, for converting a plurality of reciprocating strokes of a second linkage to rotational motion of a shaft which is mounted for rotation through a circle in one direction and an arm which is turned by said shaft and which is used for stretching said two coil springs and erecting said links; and (g) means, operated separately from said conversion means, for selectively releasing the energy stored in said one spring by further rotation of said shaft in said one direction to close said contacts and for thereafter collapsing said links to release the energy stored in said other spring to open said contacts without further rotation of said shaft, whereby said lever arm is rotated one way under the force of said one spring and then another way under the force of said other spring and said contacts are first closed and then opened.

17. The mechanism of claim 16, further including a motor for turning said shaft to store energy in said springs, and one way clutch means for coupling the rotation of said motor to said shaft, whereby said motor stretches said springs independent of the operation of said second linkage.

18. The mechanism of claim 16, wherein said conversion means includes one way clutch means to permit rotation of said shaft in only one direction.

19. The mechanism of claim 16, wherein said conversion means includes prevention means for preventing further rotation of said shaft by said second linkage after said two springs are stretched and said links are erected.

20. The mechanism of claim 19, wherein said second linkage comprises a second collapsible linkage which comprises two short links pined to each other, and wherein said prevention means comprises link means for aligning said two short links along a line of action, whereby rectilinear motion of on short link along said line of action is transmitted to the other short link, and for freeing the pined ends of said two short links to move transverse to said line of action, whereby rectilinear motion of one short link is not transmitted to the other short link.

21. The mechanism of claim 20, wherein said link means frees said pined ends of said short links to move transverse to said line of action when said springs are fully stretched.

* * * * *